US005299370A

United States Patent [19]

Gyori et al.

[11] Patent Number: 5,299,370

[45] Date of Patent: Apr. 5, 1994

[54] EXCAVATION APPARATUS

[75] Inventors: Wesley Gyori; Ronald Gyori; Wendel Gyori, all of Rimbey; Brian Pacey, Calgary, all of Canada

[73] Assignee: Badger Daylighting Inc., Calgary, Canada

[21] Appl. No.: 981,663

[22] Filed: Nov. 25, 1992

[51] Int. Cl.[5] ..... E02F 3/88

[52] U.S. Cl. ..... 37/347; 37/905; 299/17

[58] Field of Search ..... 299/17; 175/213, 67, 175/217; 37/80 R, 58, 63, 320, 317, 323, 335, 347, 905

[56] References Cited

U.S. PATENT DOCUMENTS

| | | | |
|---|---|---|---|
| 4,479,741 | 10/1984 | Berti et al. | 37/63 X |
| 4,795,217 | 1/1989 | Hilan's | 299/17 X |
| 4,854,058 | 8/1989 | Sloan et al. | 37/63 |
| 4,936,031 | 6/1990 | Briggs et al. | 37/80 R |
| 5,016,717 | 5/1991 | Simons et al. | 299/17 X |

*Primary Examiner*—Randolph A. Reese
*Assistant Examiner*—J. Russell McBee
*Attorney, Agent, or Firm*—Keck, Mahin & Cate

[57] ABSTRACT

An excavation apparatus includes a tank partitioned into two isolated chambers. One of the chambers is adapted to hold fresh water and communicates with a flexible wand to be carried by operating personnel. The other chamber is adapted to hold excavated material and communicates with a flexible hose also to be carried by operating personnel. A single, positive displacement vacuum pump driven by a motor is selectively connectable to one or both chambers through a series of valves and hoses. Depending on the valve positions, either the intake or exhaust port of the vacuum pump is in communication with one or both the chambers. The vacuum pump can therefore by used to fill the front chamber with fresh water as well as to pressurize the front chamber so that the water held therein can be discharged through the wand under pressure sufficient to dislodge earth at the excavation site. The vacuum pump can then be used to draw the dislodged earth and discharged water into the other chamber. When the other chamber becomes full, the vacuum pump can pressurize that chamber to discharge the contents therein via the flexible hose at a location away from the excavation site.

12 Claims, 7 Drawing Sheets

EXCAVATION APPARATUS

FIELD OF THE INVENTION

The present invention relates to an excavation apparatus and in particular to an excavation apparatus which discharges water under pressure to dislodge earth at an excavation site.

BACKGROUND OF THE INVENTION

Excavation devices for digging holes and trenches to uncover buried objects such as pipelines and the like are well known in the art. When using a mechanical excavation device, such as a front-end loader or back hoe, to uncover a buried pipeline, strict guidelines are imposed to ensure that the devices do not get too close to the pipeline. These guidelines are imposed for safety reasons and particularly to guard against accidental rupture of the pipeline. This is particularly important when the pipeline carries flammable liquids, gases or other explosive substances.

In typical operating conditions, the above-mentioned machines are used to excavate the area adjacent the pipeline and once this is done, the remaining earth over the pipeline is excavated by shovel or other suitable hand carried tool. Although this method of excavating a buried object works satisfactory, labour costs and the time taken to uncover the pipeline are significant. In addition, if the pipeline is buried fairly deep in the earth, the walls of the excavation must be shored while workers are digging. This necessary safety precaution further increases costs and the time taken to excavate the pipeline.

To overcome these problems associated with the above-described prior art method of excavating a pipeline, a hydro-vacuum excavating system has been developed. This prior art system includes two separate devices each of which is carried by a large transport truck. One of the devices is in the form of a high pressure water sprayer which includes a large tank, holding water to be sprayed, supported on the chassis of the truck. A boom is on the top of the tank and supports a hose extending from the tank. The boom is movable to allow the discharge end of the hose to be directed to an excavation site. A high pressure pump forces water from the tank through the hose. The water exits a nozzle at the discharge end of the hose in a narrow stream at a sufficient pressure to cut a swatch through the ground at the excavation site. Depending on the setting of the nozzle, the size of the swatch cut by the narrow stream can be varied.

The other device is in the form of a cleaner and similarly includes a tank supported by the chassis of the other truck. The tank is designed to receive the earth dislodged the stream of water together with the sprayed water. A hose extends from the tank and is supported by a movable boom to allow the intake end of the hose to be directed to the excavation site. The cleaner includes a blower to create the necessary suction in the hose to draw the water and dislodged earth into the tank.

Although this system works satisfactorily, it is not suitable in many environments. For example, in isolated areas the roadways often are unsuitable for passage of the large trucks carrying the system. Also, in many areas the ground on which work is to be performed is not capable of supporting the large trucks carrying the system. Accordingly, there exists the need for an excavation apparatus which is suitable in practically all environments and which is readily transportable.

It is therefore an object of the present invention to provide a novel excavation apparatus.

SUMMARY OF THE INVENTION

According to the present invention there is provided an excavation apparatus comprising:

a tank partitioned into at least two isolated chambers, one of said chambers being adapted to hold fluid to be sprayed and the other of said chambers being adapted to receive excavated material;

conduit means in fluid communication with said one and other chambers;

pump means to force fluid from said one chamber through said conduit means and onto an area to be excavated at a pressure sufficient to dislodge earth; and vacuum means to draw excavated material and/or sprayed fluid into said other chamber via said conduit means.

Preferably, the pump and vacuum means are constituted by a single, positive displacement vacuum pump. It is also preferred that the vacuum pump is connected to each of the chambers via a conduit and through a four-way valve, the valve being actuable to connect selectively the vacuum pump to the chambers. Preferably, the four way valve is actuable to connect selectively the intake or exhaust port of the vacuum pump to each of the chambers to allow fluid to be drawn into or discharged from each of the chambers.

It is also preferred that the conduit means includes a first conduit in fluid communication with the one chamber and a second conduit in fluid communication with the other chamber, both the first and second conduits being readily manipulatable by operating personnel.

In another aspect of the present invention there is provided an excavation apparatus comprising:

a tank partitioned into at least two isolated chambers, one of said chambers being adapted to hold fluid to be sprayed and the other of said chambers being adapted to receive excavated material;

a first conduit in fluid communication with said one chamber to discharge said fluid from said one chamber under sufficient pressure to dislodge earth at an excavation site;

a second conduit in communication with said other chamber;

a vacuum pump having an exhaust port and an intake port; and valve means actuable to connect selectively one of said exhaust and intake ports to one of said chambers to allow excavated material and/or sprayed fluid to be drawn into or discharged from said other chamber via said second conduit and to allow fluid to be drawn into or sprayed from said one chamber via said first conduit.

In one embodiment, the tank and the vacuum pump are mounted on side by side support frames. The support frames have flanges and are fastened to a support platform which is dimensioned to be received in a small vehicle such as a pick-up truck, 4×4 or the like. The platform can also be removed from the vehicle to allow the excavation apparatus to be carried to the excavation site.

The present invention provides advantages in that due to its compact nature through the use of a single, partitioned tank and a single vacuum pump, the excavation apparatus is readily transportable to basically any location. Also, manufacturing costs are significantly reduced as compared with currently available hydrovacuums system which require large, dedicated vehicles.

BRIEF DESCRIPTION OF THE DRAWINGS

Embodiments of the present invention will now be described more fully with reference to the accompanying drawings in which.

DESCRIPTION OF THE PREFERRED EMBODIMENTS

Figure 2:
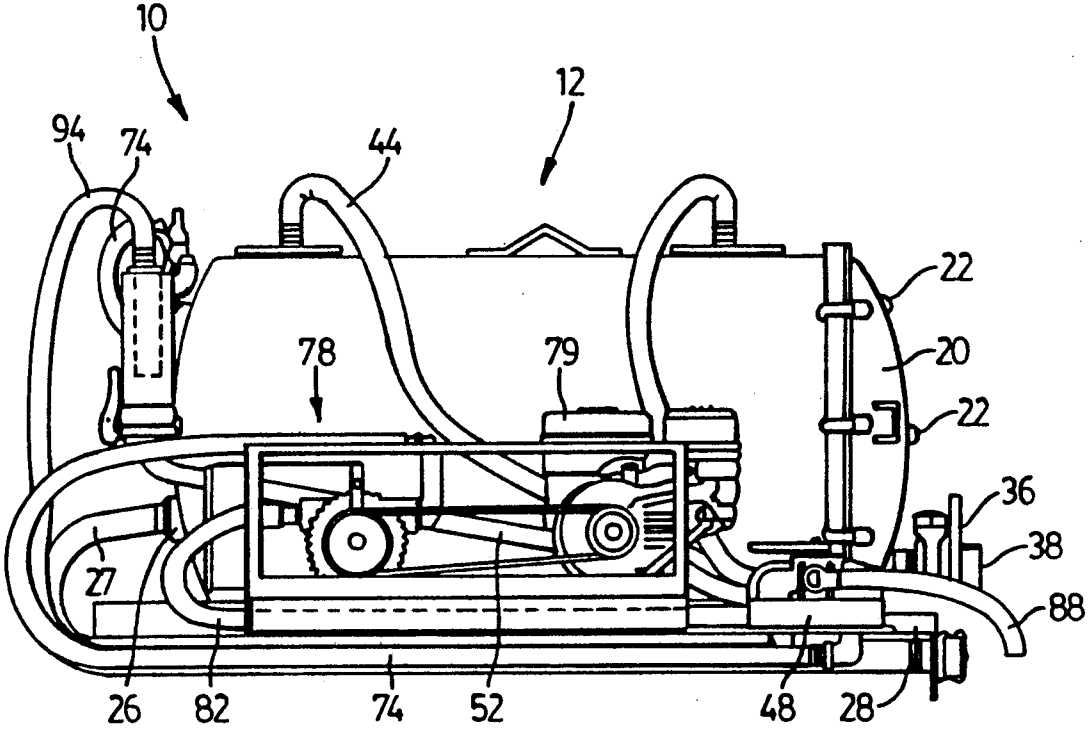
FIG. 2 is a side view of the apparatus shown in FIG. 1.
Figure 1:
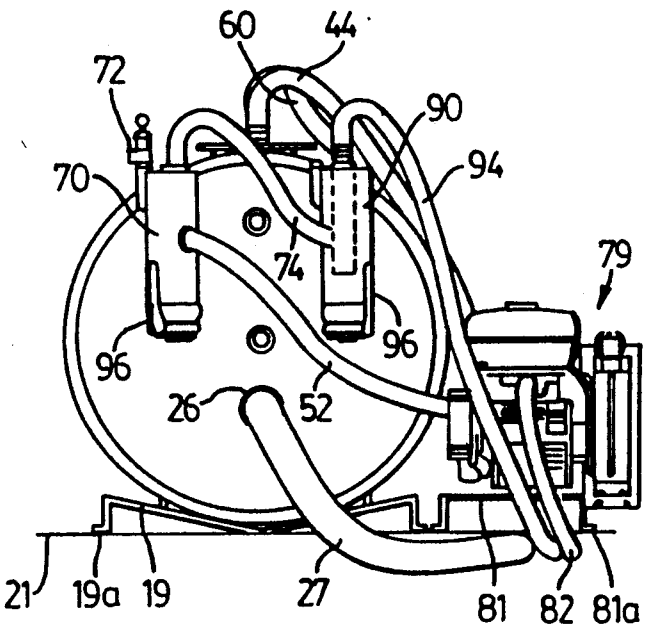
FIG. 1 is an end view of an excavation apparatus.
Figure 3:
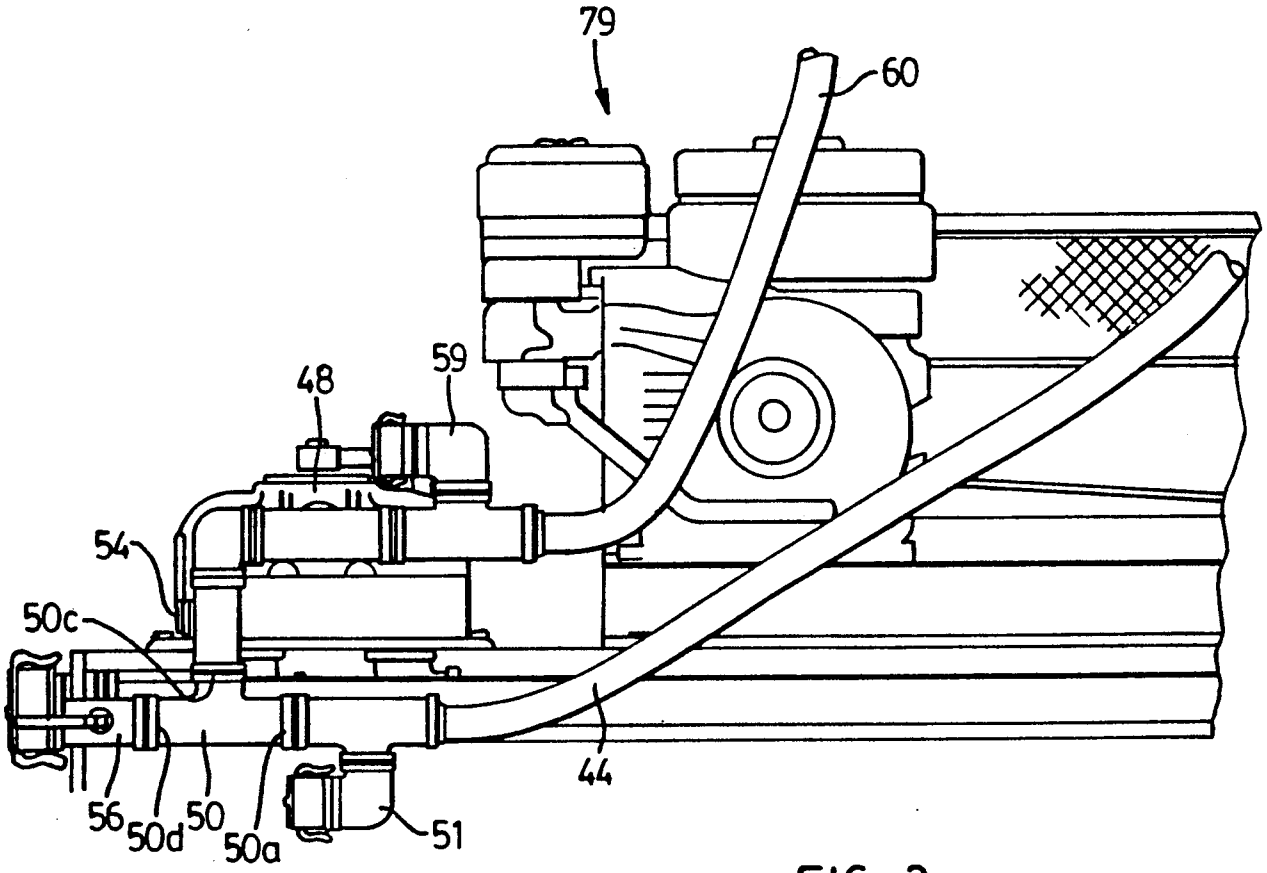
FIG. 3 is an enlarged side view opposite that of FIG. 2 of a portion of the apparatus shown in FIG. 1.
Figure 4:
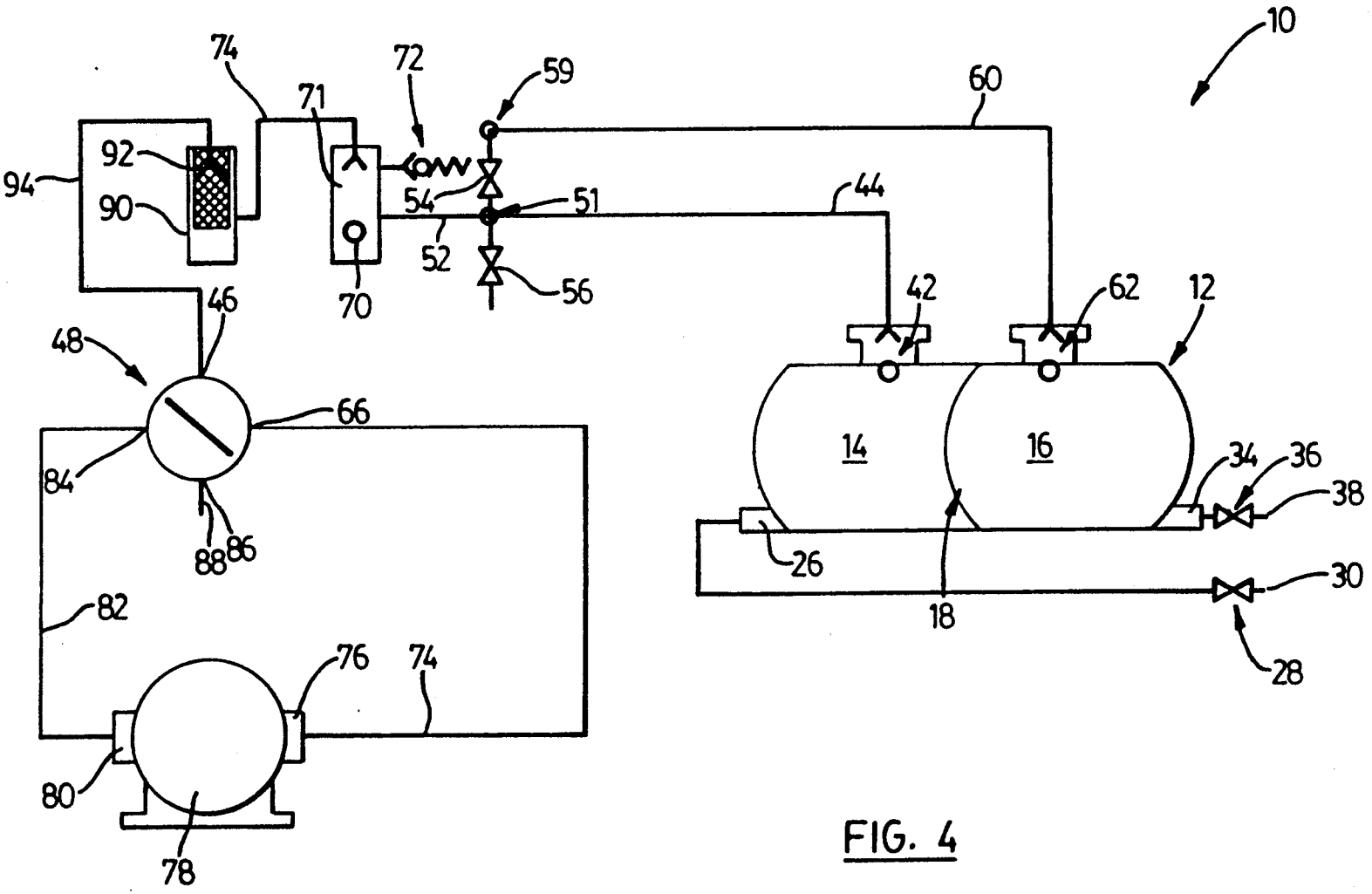
FIG. 4 is a schematic of the apparatus shown in FIG. 1.
Figure 5:
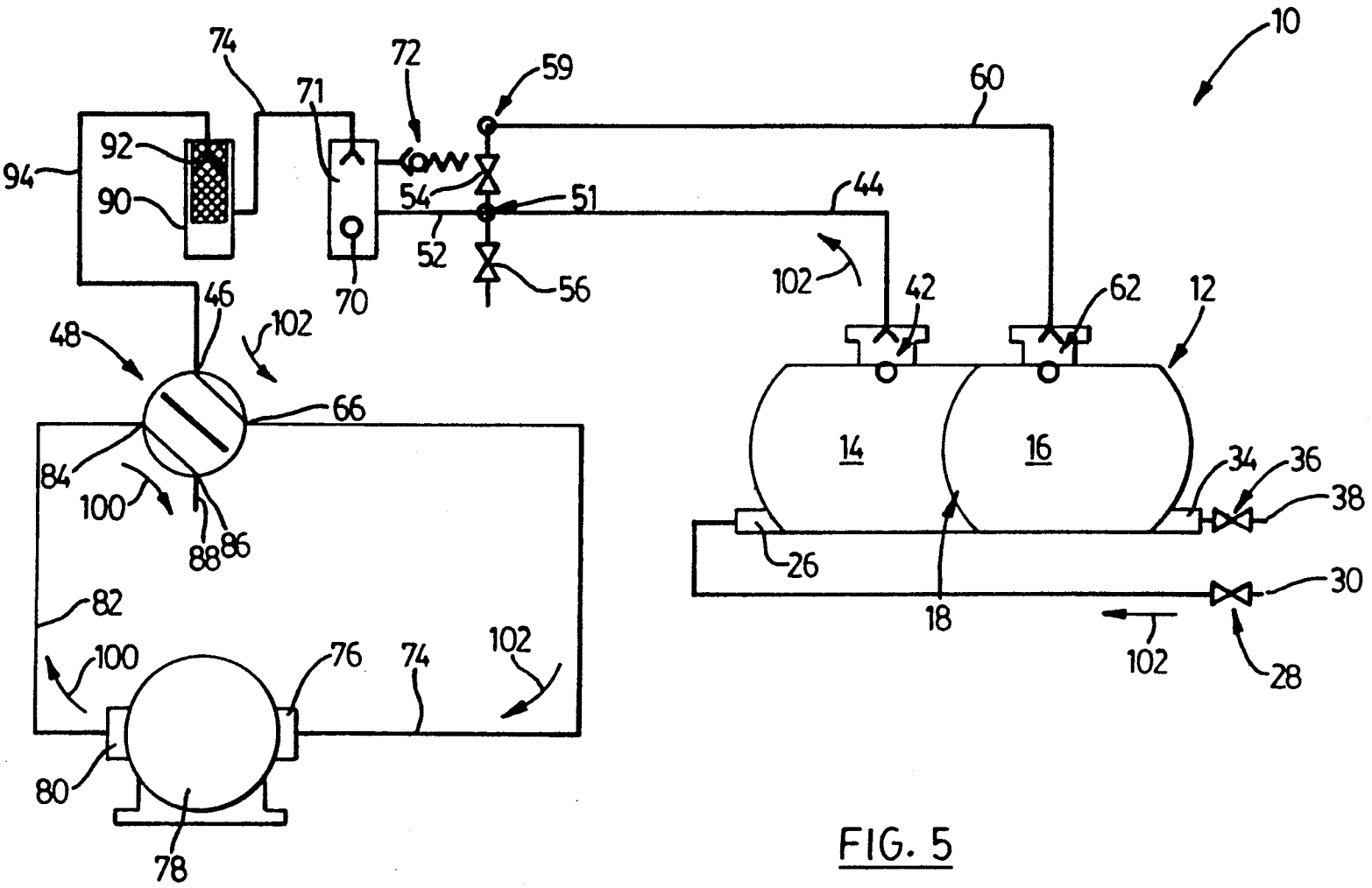
FIG. 5 is schematic of the apparatus shown in FIG. 1 in one mode of operation.
Figure 6:
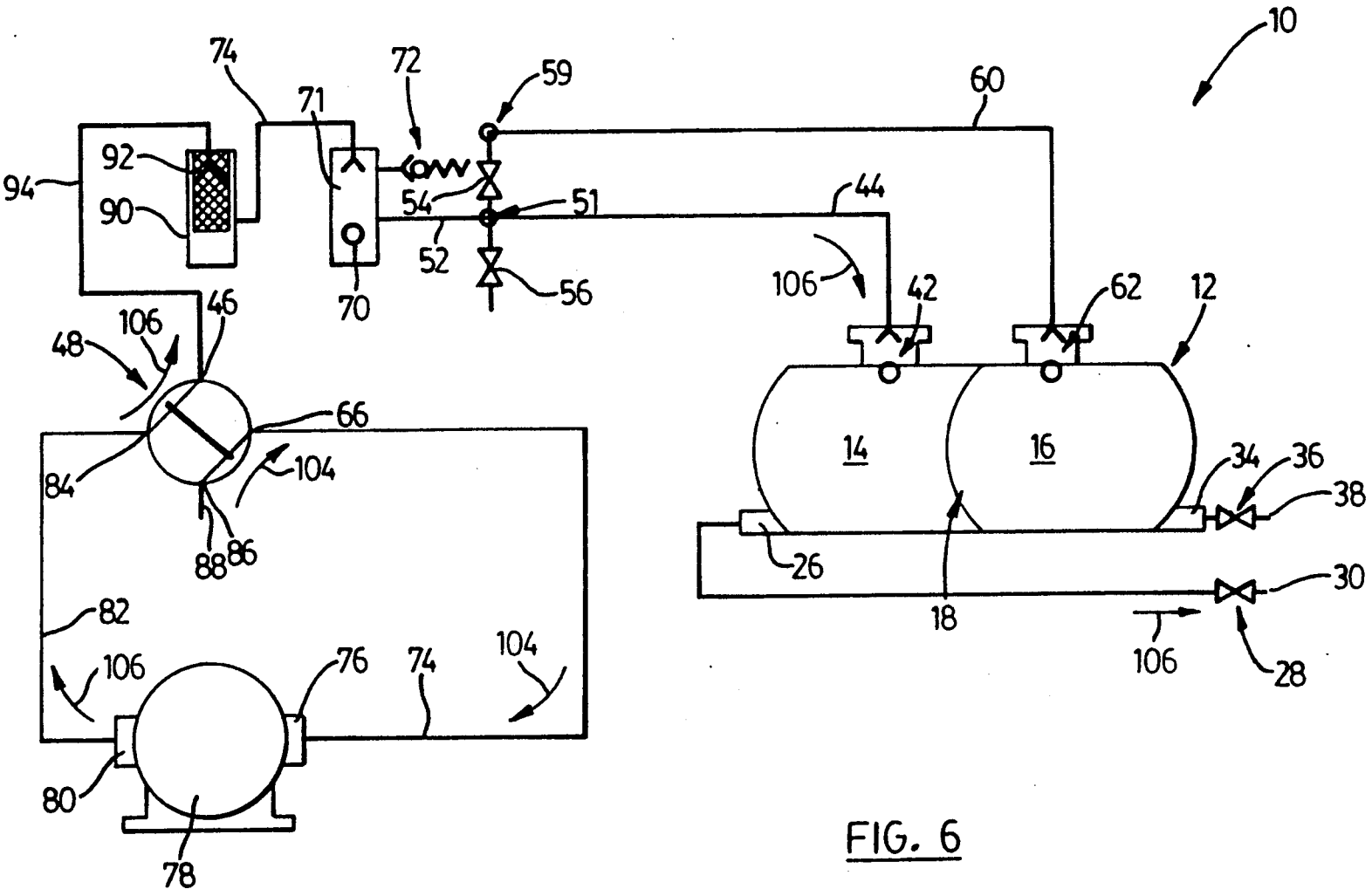
FIG. 6 is schematic of the apparatus shown in FIG. 1 in another mode of operation.

Referring now to FIGS. 1 to 4, an excavation apparatus is shown and is generally indicated by reference numeral 10. The apparatus 10 is operable to excavate buried objects by discharging a narrow stream of fluid under pressure to dislodge earth covering the object to be uncovered. The apparatus 10 is also operable to suck up the dislodged earth and sprayed fluid to clean the excavation site so that the excavation process can be visually assessed. Details of the apparatus 10 and its operation will now be described.

As can be seen, the apparatus 10 includes a cylindrical tank 12 partitioned into front and rear, isolated chambers 14 and 16 respectively by an intermediate wall 18. The tank 12 is mounted on a support frame 19. The frame 19 has outwardly extending flanges 19*a* secured to a support platform 21 by suitable fasteners (not shown). The rear wall of the tank 12 is hinged to form a door 20 which can be opened to expose the interior of the rear chamber 16 allowing it to be cleaned. A pair of vertically spaced, view windows 22 are provided on the door 20 so that the content level in the rear chamber 16 can be visually determined.

The front chamber 14 is designed to hold fresh water or other fluid suitable to function as the cutting medium. An inlet/outlet 26 is provided in the front wall of the tank 12 adjacent the bottom thereof. One port of a valve 28 communicates with the inlet/outlet 26 via a hose 27 while the other port of the valve 28 has a wand 30 to be carried by operating personnel connected to it. The valve 28 can be closed to isolate the wand 30 and the front chamber 14 or can be opened to permit fluid flow therebetween. The wand 30 includes a flexible hose connected to the valve 28 and terminates in a rigid conduit. The flexible hose allows the wand 30 to be carried to the excavation site while the rigid conduit allows operating personnel to direct the fluid to be sprayed with a reasonable degree of accuracy.

The rear chamber 16 is designed to hold excavated material together with the fluid sprayed by the wand 30. An inlet/outlet 34 is provided on the door 20 adjacent the bottom thereof. One port of a valve 36 communicates with the inlet/outlet 34 while the other port of the valve 36 has a flexible hose 38 connected to it. A rigid conduit (not shown) is located at the end of the flexible hose 38. The valve 36 can be closed to isolate the hose 38 and rear chamber 16 respectively or can be opened to permit fluid flow therebetween. The flexible hose 38 can also be carried by operating personnel to the excavation site so that the excavated material can be removed. The rigid conduit facilitates carrying and placement by operating personnel.

At the top of the tank 12 is a float valve 42 having one port in fluid communication with the front chamber 14. The other port of the float valve 42 has a conduit in the form of a flexible hose 44 connected to it. The other end of the hose 44 is connected to one port 50*a* of a four port diverter 50. A second port (not shown) of the diverter 50 is connected to a moisture trap 70 via a flexible hose 52. A drain 51 is intermediate the diverter 50 and the hose 44.

The moisture trap 70 has a float valve 71 in it which closes when the moisture level in the trap reaches a predetermined level. A pressure relief valve 72 is also provided on the moisture trap 70 to relieve internal pressure within the trap should it exceed the rating of the pressure relief valve 72. A conduit 74 in the form of a flexible hose extends from the top of the moisture trap 70 to the inlet of a second moisture trap 90. The moisture trap 90 has a filter basket 92 in it which functions to screen any fluid passing therethrough and trap solid material therein. A conduit 94 in the form of a flexible hose extends from an outlet at the top of the moisture trap 90 to a first port 46 of a four way valve 48. Both moisture traps 70 and 90 respectively have manual releases 96 at their bottoms to permit fluid and any solid material held therein to be drained.

A third port 50*c* of the diverter 50 is connected to an isolation valve 54 while the fourth port 50*d* of the diverter is connected to a relief valve 56. A conduit 60 in the form of a flexible hose is connected to the other port of the isolation valve 54 via a drain 59. The hose 60 extends to the top of the tank 12 and is connected to one port of another float valve 62. The other port of the float valve 62 communicates with the interior of the rear chamber 16.

A second port 66 of the four way valve 48 is connected to a conduit in the form of a flexible hose 74. The hose 74 extends to the intake port 76 of a positive displacement, vacuum pump 78. A gas powered motor 79 drives the vacuum pump 78.

The motor 79 and the vacuum pump 78 are mounted on a support frame 81. The frame 81 has outwardly extending flanges 81*a* fastened to the support platform 21 to maintain the frame 81 in place beside the tank 12. The support platform 21 is dimensioned so that it may be carried in relatively small vehicles such as pick-up trucks, 4×4's and the like thereby facilitating transportation of the apparatus 10 to excavation sites. The platform 21 may also be removed from the vehicle allowing the apparatus 10 to be brought into close proximity to the excavation site.

The exhaust port 80 of the vacuum pump 78 has a conduit in the form of a flexible hose 82 connected to it which terminates at a third port 84 of the four way valve 48. The fourth port 86 of the four way valve 48 functions as an inlet/outlet and has an open ended flexible hose 88 connected to it. Depending on the settings of the four way valve 48, the isolation valve 54, the relief valve 56 and the valves 28 and 36, the apparatus 10 can be conditioned into one of the four different modes. These modes include an excavation preparation mode, an excavation mode, an extraction mode and a cleaning mode, each of which will be described further hereinafter.

The operation of the apparatus 10 will now be described with particular reference to FIGS. 5 to 8. When it is desired to excavate a buried pipeline or the like, the apparatus 10 is operated so that pressurized fluid stored in the front chamber 14 is discharged through the inlet/-outlet 26, valve 28 and out of the nozzle at the end of the wand 30. The fluid discharged from the wand 30 is at a pressure sufficient to cut through and dislodge the earth covering the object to be excavated. The discharged fluid and dislodged earth is then drawn into the rear chamber 16 via the hose 38, the valve 36 and the inlet/-outlet 34. When the rear chamber 16 is full, the contents of the rear chamber can be discharged via the hose 38, valve 36 and inlet/outlet 34 to a convenient location away from the excavation site. Similarly, when the fluid level in the front chamber 14 drops significantly, it can be replenished by drawing water into the front chamber via the wand 30, the valve 28, the hose 27 and the inlet/-outlet 26.

Details of the above-described operation of the apparatus 10 will now be described. When it is desired to fill the front chamber 14 with fresh water or other suitable fluid, the valve 28 interconnecting the wand 30 and the hose 27 is opened. The isolation and relief valves 54 and 56 respectively together with the drains 51 and 59 are closed to isolate the hose 60 from the hose 44. The four way valve 48 is conditioned to interconnect the first and second ports 46 and 66 and to interconnect the third and fourth ports 84 and 86 respectively (see FIG. 5). Once this is done, the apparatus 10 is ready to be operated in the excavation preparation mode. Thereafter, the motor 79 is started to drive the vacuum pump 78.

When the vacuum pump 78 is operated, the vacuum pump 78 draws air into its intake 76 and expels air via its exhaust 80. The air exhausted by the pump 78 travels along hose 82 to the four way valve 48. At the four way valve, the forced air passes from the third port to the fourth port and is expelled from the apparatus 10 via the exhaust hose 88 as indicated by arrows 100 in FIG. 5. The vacuum created at the intake 76 of the vacuum pump 78 creates a vacuum at the wand 30 since the first and second ports of the four way valve 48 are interconnected and the valve 28 interconnecting the wand 30 and the hose 27 is open as indicated by arrows 102 in FIG. 5.

When the wand 30 is submersed in a fluid, the created vacuum draws fluid into the wand 30, through the valve 28, through the hose 27 and into the front chamber 14 via the inlet/outlet 26. This operation continues until the fluid level in the front chamber 14 reaches the top of the chamber at which time the float valve 42 closes. If the float valve 42 fails and fluid is drawn into the hose 44 through the diverter 50 and hose 52, the fluid is collected in the secondary moisture trap 70. The float valve 71 in the moisture trap 70 closes when the fluid level in the moisture trap 70 reaches a certain level to avoid fluid from entering the intake 76 of the vacuum pump 78 via the hose 74. The trap 90 functions to collect any fluid that may pass through the moisture trap 70 and filters any fluid that may be drawn through the moisture trap 90 into the four way valve 48.

Once the front chamber 14 is full, the vacuum pump and motor 78 and 79 respectively are shut off. At this time, the apparatus 10 is ready to be conditioned to the excavation mode (see FIG. 6). In the excavation mode, the four way valve 48 is conditioned to connect the first and third ports 46 and 84 and to interconnect the fourth and second ports 86 and 88 respectively. The isolation and relief valves 54 and 56 are maintained in the closed condition and the valve 28 interconnecting the wand 30 and the hose 27 is closed. At this time, vacuum pump 78 is driven by the motor 79 so that air is drawn into the intake 76 via the hose 88, the four way valve 48 and hose 74 as indicated by arrows 104 in FIG. 6. The air expelled from the exhaust 80 is directed along hose 82 through the four way valve 48 to hose 44 via the two moisture traps 70 and 90 respectively. The forced air is then directed into the front chamber 14 through the float valve 42 to pressurize the front chamber 14 as indicated by arrows 106 in FIG. 6. This operation is continued until a pressure gauge (not shown) on the tank 12 indicates that the fluid contents in the front chamber 14 is under sufficient pressure. As mentioned previously, the relief valve 72 opens if the internal pressure within the moisture trap 70 exceeds a predetermined pressure when air is being forced through it into the hose 44.

With the front chamber under sufficient pressure, the valve 28 is opened so that the pressurized fluid in the front chamber 14 is discharged through the wand 30 and directed to the area to be excavated. The high pressure fluid exiting the wand 30 is under sufficient pressure to dislodge the earth covering the object to be uncovered.

The apparatus 10 is operated in this manner until either the fluid level in the front chamber 14 drops significantly or the object to be uncovered is exposed. Once either of the above conditions occur, the motor 79 and pump 78 are shut off. At this time, the valve 28 is closed and the valve 36 is opened. The isolation valve 54 is then opened and the relief valve 56 is maintained closed. The four way valve 48 is then conditioned to interconnect the first and second ports 46 and 66 and to interconnect the third and fourth ports 84 and 86 respectively. With the valves set in this manner, the apparatus 10 is conditioned in the extraction mode. The motor 79 is then driven to operate the vacuum pump 78 and hose 38 is placed in the excavation site.

Figure 7:
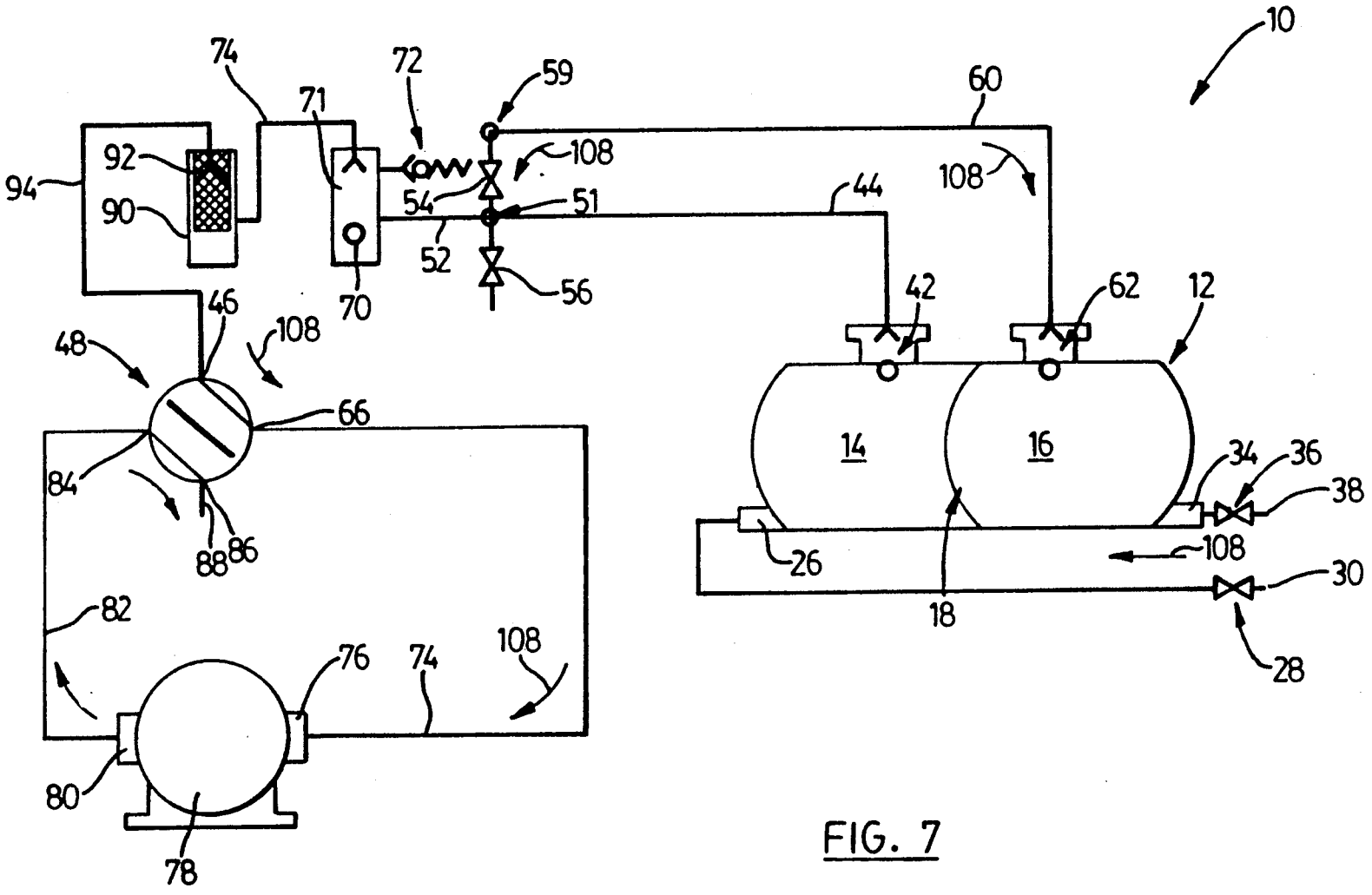
FIG. 7 is a schematic of the apparatus shown in FIG. 1 in yet another mode of operation.
Figure 8:
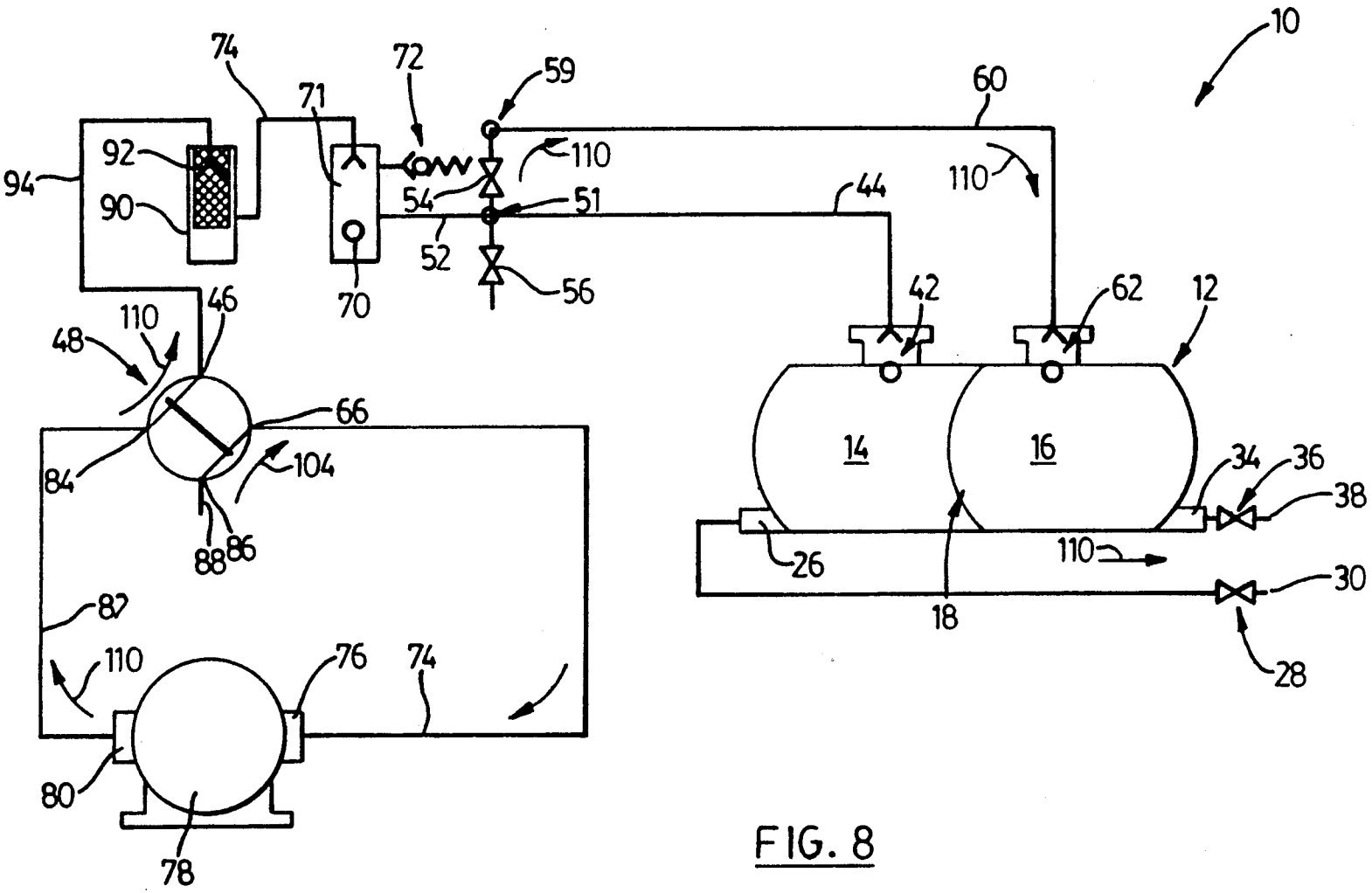
FIG. 8 is a schematic of the apparatus shown in FIG. 1 in still yet another mode of operation.

When the pump 78 operates, the dislodged earth and the water discharged by the wand 30 is drawn into the rear chamber 16 via the valve 36 and the inlet/outlet 34 as indicated by arrows 108 in FIG. 7. This operation continues until the rear chamber 16 is full or the excavation site has been cleaned. The float valve 62 on the tank 12 closes when the level of excavation material in the rear chamber reaches the top of the tank. If the float valve 62 fails, the moisture trap 70 will collect fluid until the fluid level therein closes the valve 71 to prevent fluid and excavation material from being drawn into the vacuum pump 78. Again the moisture trap 90 collects any fluid that may pass through the moisture trap 70 and ensures that solid material is not drawn into the vacuum pump 78 via the four way valve 48.

Once the rear chamber 16 is full, the motor 79 and pump 78 are shut off and the four way valve 48 is conditioned to interconnect the first and third ports 84 and 46 and to interconnect the fourth and second ports 88 and 66 respectively. The valves 30 and 56 are kept closed and the isolation valve 54 is kept open to condition the apparatus 10 to the cleaning mode. The hose 38 is then moved to a location away from the excavation site and the valve 30 is opened. The pump 78 is then driven by the motor 79 to force air from the exhaust 80 through hoses 82, 44 and 66 into the rear chamber 16 as indicated by arrows 110 in FIG. 8. This forces the excavation material in the rear chamber 16 through the inlet/outlet 34 into the hose 38 by way of the valve 36 so that it may be discharged from the apparatus.

After the contents in the rear chamber 16 have been discharged, the entire operation can be performed again to refill the front chamber 14 with fluid so that more excavating can be done. Alternatively, the door 20 can be opened so that the interior of the rear chamber 16 can be cleaned.

The rear chamber 16 can also be drained under the influence of gravity and without the assistance of the pump 78. To drain the rear chamber 16 in this manner, the relief valve 56 and the valve 38 are opened allowing air to enter the rear chamber 38 via hose 60. As air enters the chamber 16, fluid in the chamber flows through the valve 36 and into the hose 38 where it is discharged from the apparatus 10.

Although it is shown that during discharge of the contents in rear chamber 16, the front chamber is also pressurized by forced air from the pump 78, it should be realized that the position of the two chambers can be reversed so that the chamber 16 is pressurized during discharge of fluid through the wand 30 and so that the chamber 14 is isolated from the chamber 16 when the chamber 16 is being pressurized.

Also, although a single isolation valve 54 is shown, it should be realized that an additional valve can be placed along hose 44 to permit each chamber 14 and 16 respectively to be pressurized independently.

It should also be apparent to those of skill in the art, that although the apparatus has been shown having the pump driven by a gas powered motor, a hydraulically operated pump may be used.

The present invention provides advantages in that a single, positive displacement vacuum pump is used to fill and empty both chambers in the tank. This permits a compact design allowing the apparatus 10 to be carried in small vehicles capable of off road travel thereby overcoming the disadvantages associated with the prior art hydro-vacuum excavation system.

We claim:

1. An excavation apparatus comprising:

a tank partitioned into at least two isolated chambers, one of said chambers being adapted to hold fluid to be sprayed and the other of said chambers being adapted to receive excavated material;

conduit means in the fluid communication with said one and other chambers;

pump means to force fluid from said one chamber through said conduit means and onto an area to be excavated at a pressure sufficient to dislodge earth; and vacuum means to draw excavated material and/or sprayed fluid into said other chamber via said conduit means, wherein said pump means and vacuum means are constituted by a single pump.

2. An apparatus as defined in claim 1 wherein said single pump is in the form of a positive displacement vacuum pump.

3. An apparatus as defined in claim 2 wherein said vacuum pump in connected to each of said chambers via a conduit and through a four-way valve, said valve being actuable to connect selectively said vacuum pump to said chambers.

4. An apparatus as defined in claim 3 wherein said four way valve is actuable to connect selectively the intake or exhaust of said vacuum pump to each of said chambers to allow fluid to be drawn into or discharged from each of said chambers.

5. An apparatus as defined in claim 4 further including at least one moisture trap intermediate said chambers and said four way valve to inhibit fluid from entering said vacuum pump via said intake.

6. An apparatus as defined in claim 1 wherein said conduit means is constituted by individual hoses connected to said respective chambers via a valve.

7. An apparatus as defined in claim 1 wherein said tank and pump are mounted on a readily transportable, support platform.

8. An excavation apparatus comprising:

a tank partitioned into at least two isolated chambers, one of said chambers being adapted to hold fluid to be sprayed and the other of said chambers being adapted to receive excavated material;

a first conduit in fluid communication with said one chamber to discharge said fluid from said one chamber under sufficient pressure to dislodge earth at an excavation site;

a second conduit in communication with said other chamber;

a pump having an exhaust port and an intake port; and valve means actuable to connect selectively one of said exhaust and intake ports to one of said chambers to allow excavated material and/or sprayed fluid to be drawn into or discharged from said other chamber via said second conduit and to allow fluid to be drawn into or sprayed from said one chamber via said first conduit.

9. An apparatus as defined in claim 8 wherein said valve means is in the form of a four way valve.

10. An apparatus as defined in claim 8 wherein said pump is in the form of a positive displacement vacuum pump.

11. An apparatus as defined in claim 10 wherein said vacuum pump is driven by a gas powered motor or is hydraulically operated.

12. An apparatus as defined in claim 8 further including at least one moisture trap intermediate said chambers and said valve means to inhibit fluid from entering said pump via said intake port.

* * * * *